US007192287B2

(12) United States Patent
Kikuchi et al.

(10) Patent No.: US 7,192,287 B2
(45) Date of Patent: Mar. 20, 2007

(54) CARD CONNECTOR

(75) Inventors: Hitoshi Kikuchi, Tokyo (JP); Kazunori Takei, Tokyo (JP); Hirokazu Takahashi, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/330,807

(22) Filed: Jan. 11, 2006

(65) Prior Publication Data

US 2006/0154506 A1 Jul. 13, 2006

(30) Foreign Application Priority Data

Jan. 13, 2005 (JP) ..... 2005-006461

(51) Int. Cl.
*H01R 12/00* (2006.01)

(52) U.S. Cl. ..... 439/64

(58) Field of Classification Search ..... 439/59, 439/62, 64, 159, 541.1, 79
See application file for complete search history.

(56) References Cited

U.S. PATENT DOCUMENTS 6,402,529 B2 6/2002 Saito et al.
7,063,539 B2 * 6/2006 Ho et al. ..... 439/64

FOREIGN PATENT DOCUMENTS

JP 2001-223044 8/2001
JP 2004-206963 7/2004

* cited by examiner

*Primary Examiner*—Khiem Nguyen
(74) *Attorney, Agent, or Firm*—Abelman, Frayne & Schwab

(57) ABSTRACT

A connector for plural kinds of cards includes a housing, and a gate-shaped slider slidable on slide rails on both sides in a card inserting space in the housing. Inserting a wider and thicker card, the card engages and moves together with the slider into the housing to contact contacts on one surface in the housing at a predetermined inserted position. Inserting a narrower and thinner card, the card enters an inner space of the gate-shaped slider, and while the slider remains stationary, the card arrives at a predetermined inserted position with the aid of a step having an inclined face in the slider, whereupon the contacting surface of the card arrives at the same level as that of the contact surface of the wider and thicker card so that the card comes into contact with the contacts to achieve an electrical connection therebetween.

4 Claims, 5 Drawing Sheets

CARD CONNECTOR

BACKGROUND OF THE INVENTION

1. Field of the Invention

The present invention relates to a card connector capable of selectively inserting into its inserting opening plural kinds of cards different in width, thickness and the like with respect to the inserting direction, for example, cards sold under the trademarks MEMORY-STICK, and MEMORY-STICK DUO.

2. Description of the Related Art

In recent years, with widespread use of small type electronic appliances and terminal units for recording and reproducing information, plural kinds of cards have been commercially available which are different in cross-sectional area with respect to the inserting direction. In use, these cards of the plural kinds are connected to connectors exclusive to the respective cards. In the case that these plural kinds of cards are selectively used for similar objects, for example, such as cards sold under the trademarks MEMORY-STICK and MEMORY-STICK DUO, it has been desired to commonly use one card connector for these cards as much as possible.

In order to comply with such a requirement, a card connector has been invented, which includes a housing formed with therein a first card receiving portion for receiving a first card, defined by a pair of first side walls for guiding side edges of the first card, and a second card receiving portion for receiving a second card, defined by a pair of second side walls for guiding side edges of the second card such that parts of the first and second card receiving portions are commonly used for respective cards as disclosed in Patent Literature 1, Japanese Patent Application Opened No. 2001-223,044.

In the case that a card connector is commonly used for cards different in thickness and width, moreover, in order to preclude terminal edges of the cards from deviating from a determined position or the contact pad of a card from being shifted from contacts, a slider is slidably provided in a housing, and a plurality of first and second contacts are separately arranged in the housing with one set of the contacts above the other set of the contacts. When a thinner card is inserted, the card is caused to engage the slider so that the cross-sectional shape of the card with respect to the inserting direction can be converted correspondingly to the difference in cross-sectional shape and size such as thinner or thicker. Such a card connector was disclosed in Patent Literature 2, Japanese Patent Application Opened No. 2004-206,963.

With a hitherto used card connector commonly used for cards different in thickness, width and the like, contact pads of the cards frequently do not coincide with positions of contacts, thereby resulting in failed contact therebetween. In order to preclude such a failed contact between the card and the contacts, the card connector commonly used for different cards described above is constructed in a manner that, for example, when a thicker card is inserted, the card is brought into contact with the first contacts provided at the upper portion of the inserting space, while when a thinner card is inserted, the card is brought into contact with the second contacts provided at the lower portion of the inserting space.

In the case that cards of different kinds are brought into contact with the separate contacts provided at the upper or the lower portions, respectively, in the above manner, it may be possible to ensure the contact between connector and cards. However, care must always be taken to ascertain whichever surface of the card should be on an upper side when it is inserted. If the card is being inserted with a surface oriented wrong, the insertion will be impeded, or damage will occur to the card or connector by the forced insertion of the card. Therefore, such a connector is quite inconvenient to users and its cost of fabrication goes up.

BRIEF SUMMARY OF THE INVENTION

It is an object of the invention to provide an improved card connector which eliminates all the disadvantages of the prior art described above.

In order to achieve the above object, according to the invention, the card connector capable of detachably fitting plural kinds of cards therein includes a housing having a card inserting space therein, slide rails provided on both sides in the card inserting space in the housing, a gate-shaped slider slidably movable on the slide rails, and a plurality of contacts arranged in a single row on one surface in the housing, thereby enabling cards different in thickness, width and the like to be inserted. When a wider and thicker card is inserted into the housing, the card engages the slider and moves together with the slider into the interior of the housing to cause the card to contact the contacts arranged on the one surface in the housing at a predetermined inserted position. When a narrower and thinner card is inserted into the housing, the card enters an inner space of the gate-shaped slider, and while the slider remains stationary, the card arrives at a predetermined inserted position with the aid of a step having an inclined face provided in the slider. When the narrower and thinner card has arrived at this position, the contacting surface of the card arrives at the same level as that of the contact surface of the wider and thicker card so that the card comes into contact with the contacts arranged on the surface in the housing to achieve an electrical connection therebetween.

The gate-shaped slider can be freely slidably moved inwardly of the housing with its legs of the gate-shape on both sides on the slide rails provided on both sides in the card inserting space in the housing. However, the gate-shaped slider can be slidable only when inserting a wider card. When inserting a narrower and thinner card, the gate-shaped slider is securely stopped and the card only is slidably moved on the step having the inclined face in the slider to arrive at the predetermined inserted position, during which the gate-shaped slider remains stationary.

In one embodiment of the invention, for this purpose, between the slide rails and both the ends of the gate-shaped slider, are arranged stoppers of spring members and anchoring pieces adapted to engage the stoppers, respectively. Only when a wider card is inserted, the stoppers are pushed by both the side edges of the card to disengage from the anchoring pieces, thereby releasing the anchored relation therebetween. As a result, the gate-shaped slider is slidably moved together with the card on the slide rails to a predetermined inserted position, thereby achieving an electrical connection between the card and the contacts.

As the card connector constructed as described above according to the invention, cards of plural kinds different in width and thickness can be selectively inserted into one card inserting opening of the card connector without requiring turning the card upside down when necessary as is the case with the prior art, and the card arrives at a predetermined inserted position in the housing with the slider being slidably moved or remaining stationary, whereupon contact surfaces of the card and the contacts can be coincident with each other. In this manner, electrical connection of plural kinds of cards can be achieved with the contacts arranged in the single row.

Therefore, without requiring turning the cards upside down, cards of the plural kinds are selectively inserted into one card inserting opening to achieve a reliable electrical connection between the card and the contacts. Moreover, it is sufficient to arrange the contacts only in the single row in the housing, which contributes to reduction in manufacturing cost in comparison with the connector having contacts arranged in a plurality of rows.

The invention will be more fully understood by referring to the following detailed specification and claims taken in connection with the appended drawings.

DETAILED DESCRIPTION OF THE INVENTION

Figure 1:
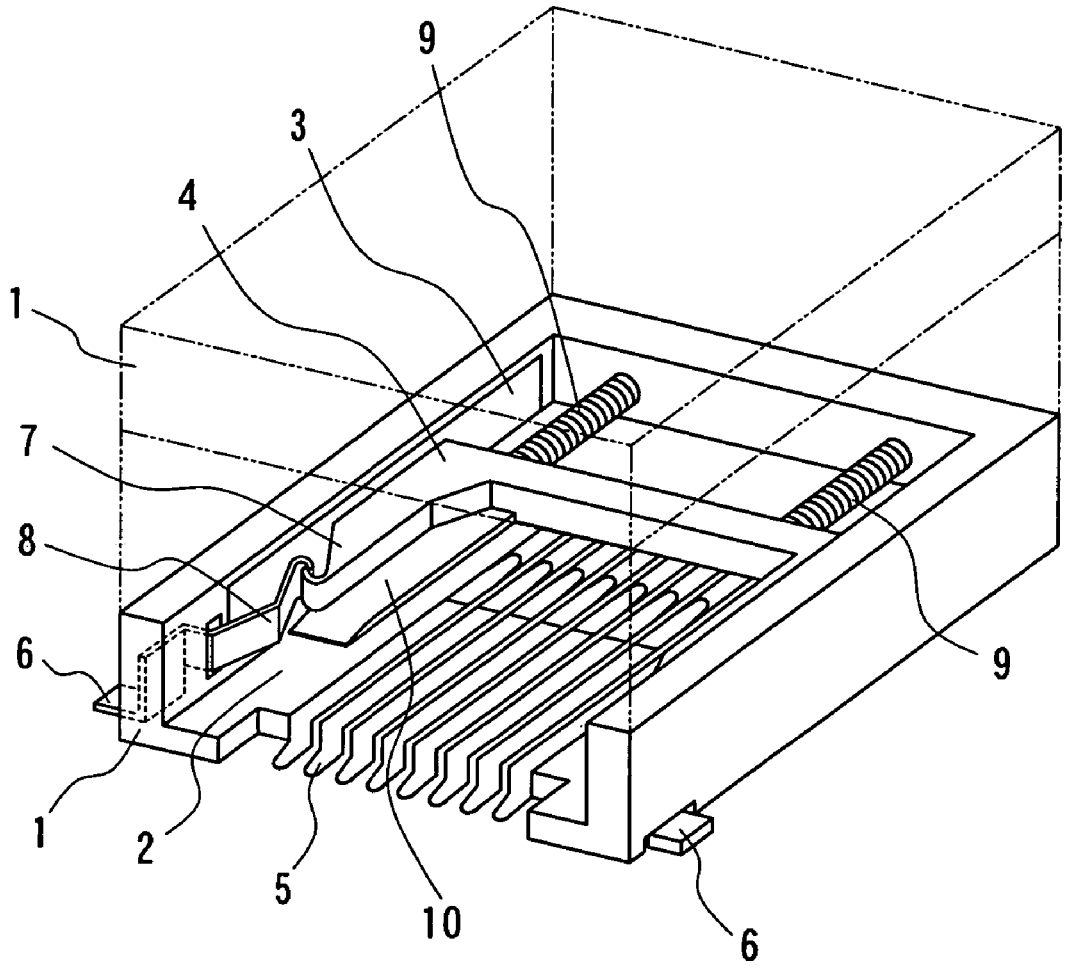
FIG. 1 is a perspective view of the card connector according to the invention with its upper cover removed to expose the interior of its housing.

FIG. 1 is a perspective view of the card connector according to the invention with its upper cover removed to expose the interior of its housing. Within a card inserting space 2 in the housing 1, there are provided slide rails 3 arranged at both the ends in the space 2, a gate-shaped slider 4 slidably movable on the slide rails 3, and a plurality of contacts 5 arranged in a single row on one surface in the housing 1.

Figure 2:
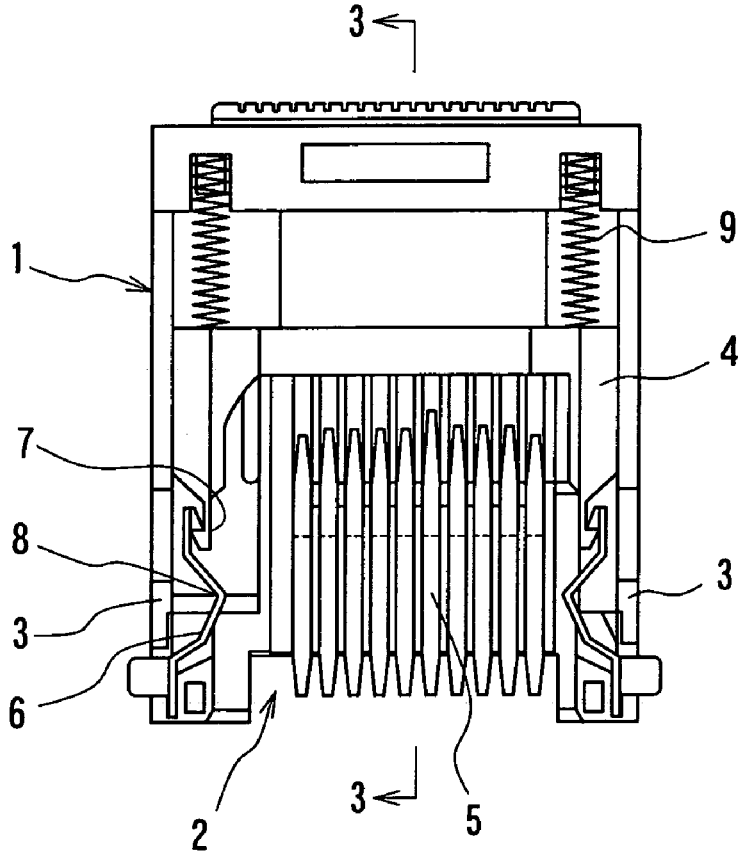
FIG. 2 is a plan view of the card inserting space in the housing.
Figure 3:
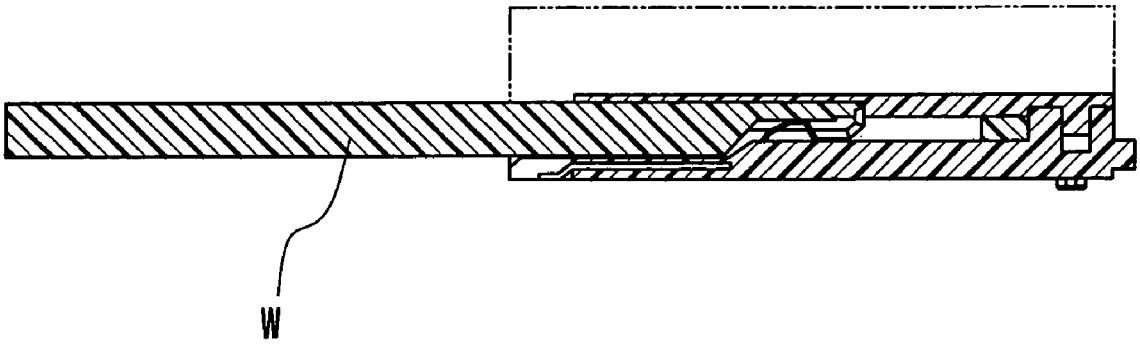
FIG. 3 is a longitudinal-sectional view taken along a line 3—3 in FIG. 2.
Figure 4:
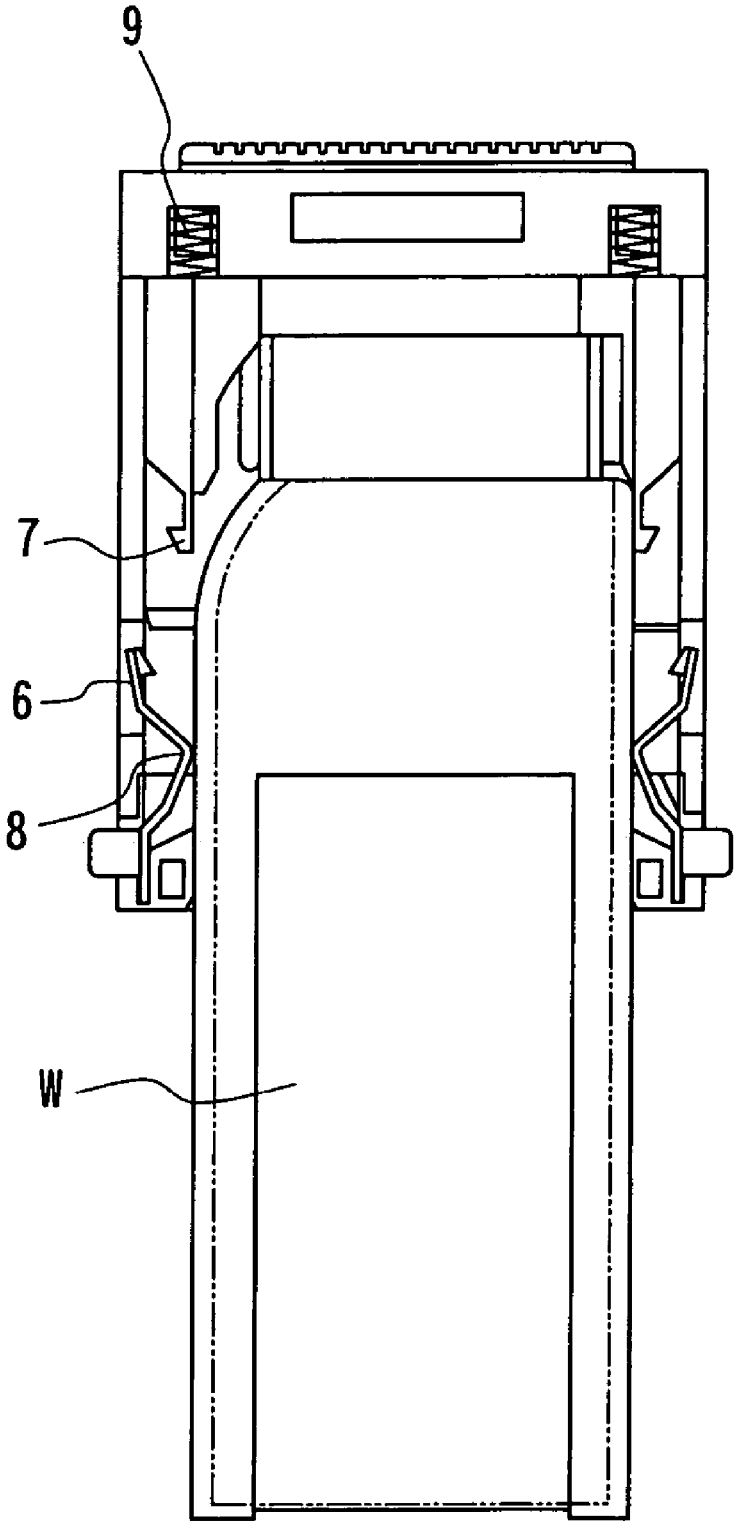
FIG. 4 is a plan view of the housing with a wider MEMORY-STICK inserted.

FIG. 2 is a plan view of the card inserting space 2 in the housing 1. FIG. 3 is a longitudinal-sectional view of the space 2 taken along a line 3—3 in FIG. 2. The slide rails 3 are each provided on the opening side with a stopper 6 made of a spring member, which is adapted to engage an anchoring piece 7 provided at each end of gate-shaped slider 4. As shown in FIG. 4, when a comparatively wide memory card, or a card sold under the trademark MEMORY-STICK, W is inserted into the space 2, extending portions 8 of the stoppers 6 are urged by side edges of the MEMORY-STICK W to be outwardly displaced so that the gate-shaped slider 4 disengages from the stoppers 6. As the MEMORY-STICK W advances into the housing 1, the forward end of the MEMORY-STICK W is brought into contact with a predetermined position on the gate-shaped slider 4. Thereafter, the MEMORY-STICK W moves together with the gate-shaped slider 4 on the slide rails 3 so that contacts (not shown) of the MEMORY-STICK W come into contact with contacts 5 in the housing, thereby electrically connecting the MEMORY-STICK W and the contacts 5.

Moreover, a plurality of coil springs 9 are arranged between the gate-shaped slider 4 and the inner extremity of the card inserting space 2 of the housing 1. When the MEMORY-STICK W is drawn from the position shown in FIG. 4, the coil springs serve to push the gate-shaped slider 4 outwardly by the expansion of the coil springs 9 so as to return it into the position where the gate-shaped slider 4 engages the stoppers 6 (the state shown in FIG. 2).

Figure 5:
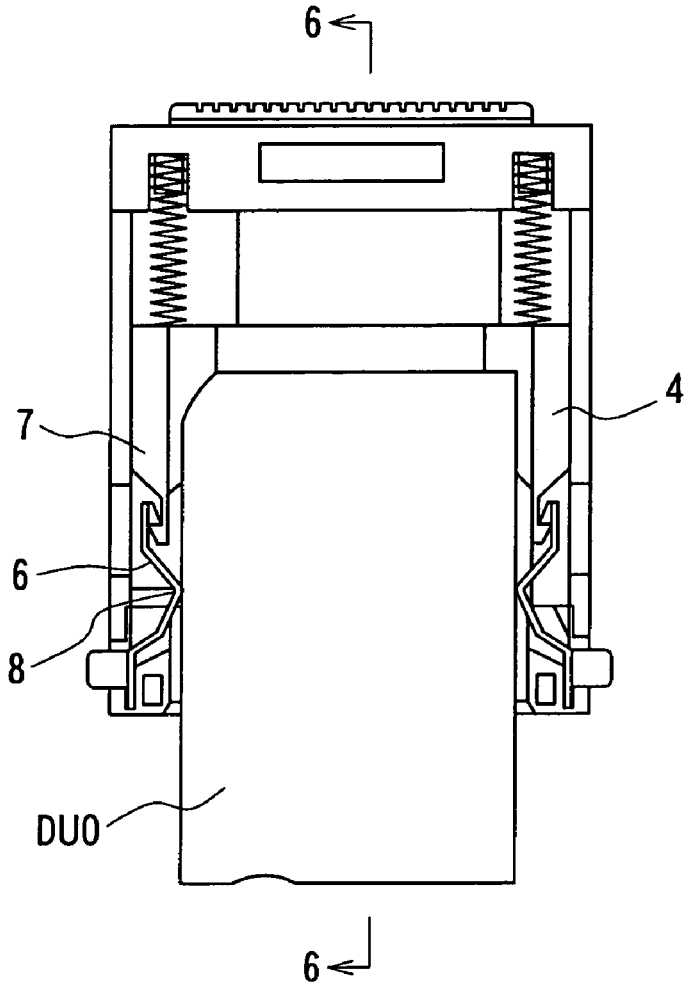
FIG. 5 is a plan view of the housing with a narrower MEMORY-STICK DUO inserted.
Figure 6:
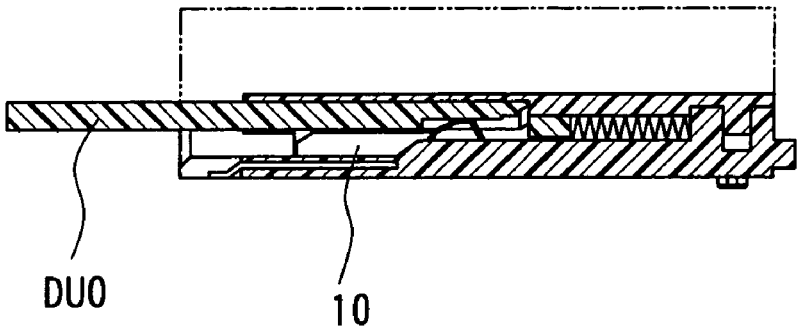
FIG. 6 is a longitudinal-sectional view taken along a line 6—6 in FIG. 5.

FIG. 5 is a plan view of the card connector with a comparatively narrow memory card, or a card sold under the trademark MEMORY-STICK DUO, inserted. FIG. 6 is a longitudinal-sectional view of the card connector taken along a line 6—6 in FIG. 5. As the MEMORY-STICK DUO is narrow in width, when being inserted into the housing 1, the stoppers 6 are not displaced outwardly so that the gate-shaped slider 4 is stationary on the slider rails 3 with the engagement of the anchoring pieces 7 with the stoppers 6. As the MEMORY-STICK DUO advances into the housing 1, the height of the MEMORY-STICK DUO is determined by a step 10 having an inclined face provided in the gate-shaped slider 4. When the MEMORY-STICK DUO arrives at a predetermined position in the gate-shaped slider 4, contacts (not shown) of the MEMORY-STICK DUO come into contact with contacts 5 in the housing, thereby electrically connecting the MEMORY-STICK DUO and the contacts. During such operations, the gate-shaped slider 4 remains stationary on the slider rails 3 and therefore the coil springs 9 provided between the slider 4 and the housing 1 are inoperative.

Figure 7:
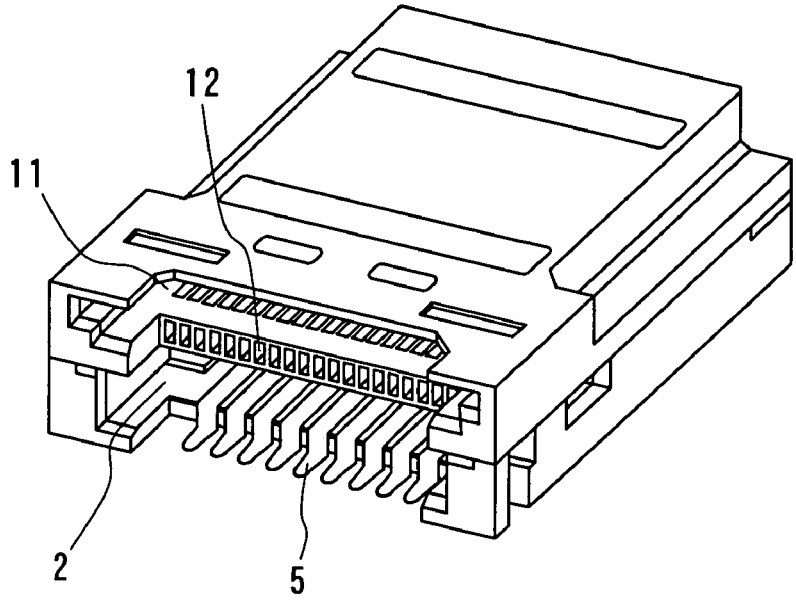
FIG. 7 is a perspective view of a card connector according to another embodiment of the invention.
Figure 8:
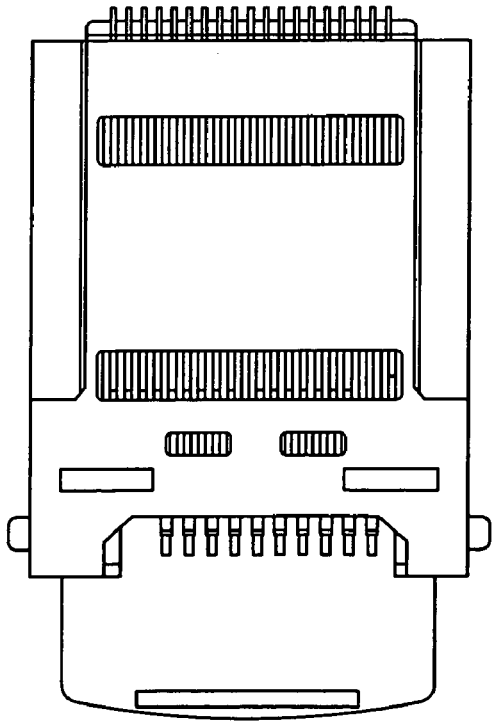
FIG. 8 is a plan view of the card connector shown in FIG. 7 with an XD card inserted.

As can be seen from the above explanation, the card connector according to the invention is capable of selectively connecting cards different in width or thickness, such as cards sold under the trademarks MEMORY-STICK and MEMORY-STICK DUO, to common contacts within a common card inserting space. In the case that it is desired to process a card, for example, cards sold under the trademark XD, other than the cards described above in the same housing, moreover, a card inserting space 11 for the XD card separate from the space 2 for the above two cards may be provided in the housing and, further contacts 12 for the XD card may be provided in the space 11 as shown in FIGS. 7 and 8.

While the invention has been particularly shown and described with reference to the preferred embodiments thereof, it will be understood by those skilled in the art that the forgoing and other changes in form and details can be made therein without departing from the spirit and scope of the invention.

What is claimed is:

1. A card connector capable of detachably fitting plural kinds of cards therein, wherein said card connector comprises:

a housing having a card inserting space therein;

slide rails provided on both sides in said card inserting space in the housing;

a gate-shaped slider slidably movable on said slide rails; and a plurality of contacts arranged in a single row on one surface in said housing;

wherein when one card of said plural kinds of cards different in width, thickness, and the like is inserted into said card inserting space, the card causes said gate-shaped slider to be selectively slidably moved so that said card comes into contact with said contacts in a predetermined inserted position to achieve electrical connection therebetween.

2. The card connector as set forth in claim 1, wherein said gate-shaped slider is provided in an inner surface thereof with a step having an inclined face along the card inserting direction, thereby enabling said card in said predetermined inserted position to be connected to said contacts.

3. The card connector as set forth in claim 1, wherein anchoring pieces made of spring members are each provided between one of said slide rails, provided on both sides in said housing, and one of the ends of said gate-shaped slider.

4. The card connector as set forth in claim 2, wherein anchoring pieces made of spring members are each provided between one of said slide rails, provided on both sides in said housing, and one of the ends of said gate-shaped slider.

* * * * *